United States Patent [19]

Weterings et al.

[11] 4,390,507

[45] Jun. 28, 1983

[54] PROCESS FOR RECOVERING YTTRIUM AND LANTHANIDES FROM WET-PROCESS PHOSPHORIC ACID

[75] Inventors: Cornelis A. M. Weterings, Stein; Johannes A. Janssen, Schinveld, both of Netherlands

[73] Assignee: Stamicarbon, B.V., Geleen, Netherlands

[21] Appl. No.: 257,116

[22] Filed: Apr. 24, 1981

[30] Foreign Application Priority Data

Apr. 26, 1980 [NL] Netherlands ..... 8002462

[51] Int. Cl.[3] ..... B01D 11/00; C01F 17/00; C22B 59/00; C01B 25/16

[52] U.S. Cl. ..... 423/8; 423/21.1; 423/21.5; 423/321 R

[58] Field of Search ..... 423/21.1, 321 R, 21.5, 423/8, 9, 10

[56] References Cited

U.S. PATENT DOCUMENTS

| | | | |
|---|---|---|---|
| 2,968,528 | 1/1961 | Tuttle et al. | 423/321 R |
| 3,647,361 | 3/1972 | Coltrinari et al. | 423/21.1 |
| 3,937,783 | 2/1976 | Wamser et al. | 423/21.1 |
| 3,965,238 | 6/1976 | Tabata et al. | 423/21.1 |

FOREIGN PATENT DOCUMENTS

| | | | |
|---|---|---|---|
| 1113922 | 5/1968 | United Kingdom | 423/321 R |

*Primary Examiner*—O. R. Vertiz
*Assistant Examiner*—Gregory A. Heller

[57] ABSTRACT

Process for recovering yttrium and lanthanides from wet-process phosphoric acid by adding a flocculant to the phosphoric acid, separating out the resultant precipitate and then recovering yttrium and lanthanides from the precipitate. Uranium is recovered from the remaining phosphoric acid.

8 Claims, No Drawings

PROCESS FOR RECOVERING YTTRIUM AND LANTHANIDES FROM WET-PROCESS PHOSPHORIC ACID

BACKGROUND AND SUMMARY OF THE INVENTION

The invention relates to processes for recovering yttrium and lanthanides from wet-process phosphoric acid.

A yttrium and lanthanides recovery process is already known from Netherlands patent application No. 6,806,472. In such process, the wet-process phosphoric acid is purified in a multi-step extraction procedure using organic compounds in the presence of a strong mineral acid followed by a multi-step re-extraction and washing procedure to obtain pure phosphoric acid and a solution containing some phosphoric acid and the strong mineral acid. The yttrium and lanthanides can be extracted from this acid containing solution.

This already known process suffers from a major drawback. The total phosphoric acid must be subjected to the laborious extraction, re-extraction, and washing operations to obtain a yttrium-containing solution suitable for subsequent yttrium recovery. Such a multi-step process involves high costs.

An object of the present invention is to provide a simple cost effective process for recovering yttrium and lanthanides from wet-process phosphoric acid without subjecting the phosphoric acid flow to these laborious and expensive multi-step operations.

According to the present invention this simple and cost effective process includes adding a flocculant to wet-process phosphoric acid, separating out the resultant precipitate, and recovering the yttrium and lanthanides from the separated precipitate.

This simple process recovers more than 75% by weight of the yttrium and lanthanides present in the wet process phosphoric acid.

Treating wet-process phosphoric acid with flocculants is already known from, for instance, "Proceedings of the British Sulphur Corporation's Third International Conference on Fertilizers" (London, November 12–14 1979). This already known process is aimed at preventing sludge formation. The Proceedings of the British Sulphur Corporation's Third Annual Conferenc on Fertilizers has no disclosure on how to recover yttrium or lanthanides from such processes.

In the process according to the present invention, various already known flocculants can be used, such as polyacrylamides, polyacrylonitriles, copolymers of acrylamides or acrylonitrile with acrylates or vinyl esters, partially hydrolyzed or sulphonated derivatives thereof, poly(meth)acrylates, diallyl polymers, styrene(-vinyl)-maleic acid copolymers, condensation products of hexamethylene diamine with dichloroethane or of methylol crotonamide with vinyl alcohol, vinyl pyridine polymers or polyethylene imines.

Particularly suitable flocculants are polyacrylamides and acrylamide-acrylate copolymers.

The flocculants are added, as usual, in the form of an aqueous solution, for instance an about 0.1% to about 10% solution, to the phosphoric acid.

The quantity of flocculant added may vary within wide limits depending in part upon the type of wet-process phosphoric acid used. For instance a flocculant from about 0.003% to about 0.1% by weight, calculated by weight of $P_2O_5$ in the phosphoric acid to be treated, can be used. In particular, about 0.008% to about 0.05% by weight of flocculant, calculated in respect of the quantity by weight of $P_2O_5$, is applied.

It has been found that the flocculant coagulates at high temperatures thereby losing most of its flocculation power. Therefore the temperature of the phosphoric acid being treated is preferably kept below 50° C.

The precipitate formed by the addition of the flocculant can be separated from the phosphoric acid in various ways, such as by draining centrifugation, filtration.

Besides yttrium and lanthanides, the precipitate contains quantities of the sulphate and fluorine compounds present in the wet-process phosphoric acid as well as most of the organic impurities. The quantities of these other substances in the precipitate are determined, in part, by the quantity of flocculant applied and the kind of wet-process phosphoric acid applied.

After separating out the precipitate, the yttrium and lanthanides are preferably recovered by treating the precipitate with an acid and then separating the yttrium and lanthanides from the resultant acid liquid. In this recovery process, the precipitate can be subjected to the acid treatment without prior processing. However, the precipitate is preferably first washed with water. If desired, the applied wash water can be added to the phosphoric acid flow or can be returned to the phosphate dissolution zone. If desired, the washed precipitate can be dried in an already known manner.

In the invention of the present process, suitable acids include among others, mineral acids, such as nitric acid, sulphuric acid or hydrochloric acid, as well as organic acids, such as oxalic acid or citric acid. When concentrated mineral acids are employed, it is advantageous to calcine the precipitate beforehand to remove the organic compounds present. The precipitate can be heated, in the presence of gases, for instance to about 400° C. to about 1100° C. Prior calcination is not necessary when using dilute mineral or organic acids.

The quantity of acid applied is not critical, but should at least suffice to dissolve the precipitate. Generally a quantity of acid of about 100% to about 1000% by weight, calculated by weight of precipitate, is applied.

From the acid liquid formed after treating the precipitate with acid, yttrium and lanthanides can be recovered, for example by precipitation, ion exchange, electrolysis or preferably by extraction with an organic compound. Suitable organic compounds include among others, organic phosphoric esters for instance alkyl phosphates, such as tributyl phosphate, alkyl pyrophosphates, alkyl phenylphosphates, such as mono and/or dioctylphenyl phosphoric acid, or branched aliphatic carboxylic acids. Preferably the extractant is applied as a solution in an organic solvent, such as kerosene.

The quantity of extractant used may vary within wide limits. To obtain satisfactory extraction efficiencies, the extractant quantities added may vary between about 10% to 100% by weight, calculated as quantity of extractant plus, as the case may be, the solvent in respect to quantity of acid liquid. Yttrium and lanthanides can be recovered from the extractant phase in various ways, for example by precipitation, ion exchange or, preferably, re-extraction. Suitable re-extractants include, for example, nitric acid or hydrochloric acid. Yttrium and lanthanides can then be recovered from the re-extraction phase, for example, by precipitation, evaporation or further extraction.

Oxalic acid is suitable as a re-extractant and the directly formed oxalate precipitates can then be converted into oxides by calcination.

After separating out the precipitate containing yttrium and lanthanides, the remaining phosphoric acid can be used for various purposes, such as the raw material for the preparation of high-grade fertilizer products, technical phosphates and cattle feed phosphate.

Without further processing, the remaining phosphoric acid is extremely suitable for liquid-liquid extraction to recover uranium since most of the compounds present in the crude phosphoric acid which have a disturbing effect in a uranium extraction process have already been removed along with the precipitate containing the yttrium and lanthanides. This increases the uranium extraction efficiency since the sulphate and fluorine compounds present in the crude phosphoric acid are at least partially removed with the precipitate.

In the process according to the present invention, 75% or more by weight of the yttrium and lanthanides present in the crude phosphoric acid are precipitated. Increasing the calcium content of the phosphoric acid being treated yields even higher yttrium and lanthanides recovery efficiencies. This has the additional advantage of simultaneously precipitating out practically all sulphate compounds from the phosphoric acid. From such a practically sulphate-free phosphoric acid, uranium can be extracted with greater efficiency.

The invention is further elucidated in the following nonlimiting example.

EXAMPLE

While stirring at 40° C., 100 grams of crude wet-process phosphoric acid with a 30 wt % $P_2O_5$ content were treated with a solution of a flocculant calculated on the basis of 4 ml of flocculant solution per liter of phosphoric acid. A 1 wt % aqueous solution of polyacrylamide flocculant (Flocculant A 1820 from American Cyanamid) was applied.

After about a 30 minute settling time, the preciptate formed was drained, washed with water and then dried. The resultant 3.4 grams of solid contained 0.32% by weight of yttrium, 0.08% by weight of lanthanum and 0.09% by weight of neodymium. The composition of the phosphoric acid before flocculation and after flocculation, and of the solid precipitate were determined. These compositions are summarized in Table I.

TABLE I

| | phosphoric acid before flocculation (100 grams). (96.6 grams) | phosphoric acid after flocculation (3.4 grams) | solid |
|---|---|---|---|
| $P_2O_5$ | 29.1% by wt | 30.1% by wt | 4.1% by wt |
| $SO_4$ | 1.5% by wt | 1.0% by wt | 14.8% by wt |
| Ca(+Sr,Mg) | 0.62% by wt | 0.36% by wt | 7.7% by wt |
| F | 1.6% by wt | 1.1% by wt | 13.8% by wt |
| C | 0.09% by wt | 0.01% by wt | 2.5% by wt |
| V | 135 ppm | 138 ppm | — |
| U | 112 ppm | 114 ppm | 23 ppm |
| Y | 136 ppm | 26 ppm | 3200 ppm |
| La | 30 ppm | 3 ppm | 800 ppm |

TABLE I-continued

| | phosphoric acid before flocculation (100 grams). (96.6 grams) | phosphoric acid after flocculation (3.4 grams) | solid |
|---|---|---|---|
| Nd | 35 ppm | 4 ppm | 900 ppm |

The solid was calcined at 800° C., then the solid was ground to a powder and, at 80° C., extracted twice with 4 parts by weight of 2 N nitric acid per part by weight of solid. The acid liquids were combined with the washing water to obtain 28.8 grams of a liquid mixture. The liquid mixture was treated with ammonia until the pH of the liquid increased to about 3.

At 30° C. the liquid mixture was heated with an extractant solution, 1 part by weight of extraction solution per 2 parts by weight of liquid. A 20% (wt) solution of di(2-ethylhexyl)phosphoric acid in kerosene was used.

The extractant phase was then treated with 6 N nitric acid, 1 part by weight of nitric acid solution per 2 parts by weight of extractant phase, to form a nitric acid phase.

After evaporation and calcining, the nitric acid phase yielded 12.0 milligrams of $Y_2O_3$, 2.7 milligrams of $La_2O_3$ and 3.1 milligrams of $Nd_2O_3$.

What we claim is:

1. Process for recovering yttrium and lanthanides from wet-process phospheric acid comprising the steps of:

(a) adding a flocculant to wet-process phosphoric acid to form a precipitate;

(b) separating out the resultant precipitate;

(c) recovering yttrium and lanthanides from the separated out precipitate by:

(i) treating said precipitate with an acid to form an acid liquid; and (ii) separating yttrium and lanthanides from the acid liquid.

2. Process according to claim 1, wherein said flocculant is added to said wet-process phosphoric acid at a temperature below 50° C.

3. Process according to claim 1, wherein said precipitate is calcined before being treated with the acid.

4. Process according to claim 1, wherein said process further comprises separating yttrium and lanthanides from the acid liquid by extraction.

5. Process according to claim 1 or 4, wherein said process further comprises:

extracting said acid liquid with an extractant selected from the class of organic phosphoric esters or branched aliphatic carboxylic acids;

separating out the extractant phase; and separating yttrium and lanthanides from the separated out extractant phase.

6. Process according to claim 5, wherein said process further comprises re-extracting yttrium and lanthanides from the extractant phase with an acid.

7. Process according to claim 1 or 2, further comprising the step of:

recovering uranium by liquid-liquid extraction from the phosphoric acid remaining after separating out the yttrium and lanthanides containing precipitate.

8. Process according to claim 5 wherein said extraction occurs in the presence of an organic solvent for the extractant.

* * * * *

UNITED STATES PATENT AND TRADEMARK OFFICE

CERTIFICATE OF CORRECTION

PATENT NO. : 4,390,507

DATED : June 28, 1983

INVENTOR(S) : Cornelis A.M. Weterings and Johannes A. Janssen

It is certified that error appears in the above-identified patent and that said Letters Patent is hereby corrected as shown below:

In Table I on column 3 and on column 4:

Under "(100 grams)" delete "(96.6 grams)".

Under "flocculation", change "(3.4 grams)" to --(96.6 grams)--.

Under "solid", insert --(3.4 grams)--.

Column 4, line 29, delete "phospheric" and insert --phosphoric--.

Signed and Sealed this

*Twenty-seventh* Day of *December 1983*

[SEAL]

*Attest:*

GERALD J. MOSSINGHOFF

*Attesting Officer*

*Commissioner of Patents and Trademarks*